United States Patent [19]

Iida et al.

[11] Patent Number: 4,682,768

[45] Date of Patent: Jul. 28, 1987

[54] BILL RECEIVING/DISPENSING APPARATUS

[75] Inventors: Koujirou Iida, Kagamigahara; Yasuo Yoshioka, Gifu; Hiroshi Ogawa, Inazawa; Kiyoshi Haruno; Tsugio Ohigashi, both of Aichi, all of Japan

[73] Assignee: Matsushita Electric Industrial Co., Ltd., Osaka, Japan

[21] Appl. No.: 744,488

[22] PCT Filed: Oct. 5, 1984

[86] PCT No.: PCT/JP84/00473

§ 371 Date: Jun. 5, 1985

§ 102(e) Date: Jun. 5, 1985

[87] PCT Pub. No.: WO85/01820

PCT Pub. Date: Apr. 25, 1985

[30] Foreign Application Priority Data

Oct. 11, 1983 [JP] Japan ..... 58-188522
Oct. 11, 1983 [JP] Japan ..... 58-188523

[51] Int. Cl.[4] ..... B65H 3/46

[52] U.S. Cl. ..... 271/3.1; 209/534; 271/122; 271/902

[58] Field of Search ..... 209/534; 235/379, 480; 194/206, 205, 207; 271/3.1, 9, 122, 125, 182, 3, 34, 902; 109/24.1

[56] References Cited

U.S. PATENT DOCUMENTS

| | | | |
|---|---|---|---|
| 3,123,082 | 3/1964 | Call et al. . | |
| 3,656,615 | 4/1972 | Ptacek | 209/534 |
| 3,773,317 | 11/1973 | Kummerer | 271/122 X |
| 4,053,152 | 10/1977 | Matsumoto | 271/9 |
| 4,239,203 | 12/1980 | Uchida | 271/122 |
| 4,540,081 | 9/1985 | Mori et al. | 209/534 X |

FOREIGN PATENT DOCUMENTS

| | | | |
|---|---|---|---|
| 50-46397 | 4/1975 | Japan . | |
| 51-77298 | 7/1976 | Japan . | |
| 54-72855 | 6/1979 | Japan . | |
| 55-143678 | 11/1980 | Japan | 209/534 |
| 56-63664 | 5/1981 | Japan | 235/319 |
| 56-78760 | 6/1981 | Japan . | |
| 57-67452 | 4/1982 | Japan | 271/3.1 |
| 57-146396 | 9/1982 | Japan . | |
| 57-189943 | 11/1982 | Japan . | |

*Primary Examiner*—Robert B. Reeves
*Assistant Examiner*—Edward M. Wacyra
*Attorney, Agent, or Firm*—Stevens, Davis, Miller & Mosher

[57] ABSTRACT

This invention relates to a bill receiving/dispensing apparatus applied to a vending machine and a money changing machine which can house and store bills inserted by users and return a desired number of bills. Provision of a reversing roller (10) makes it possible to ensure that in paying out a bill (1) only a single bill is paid out at a time from a plurality of bills (3) overlaid one on another in a bill storing device (2).

6 Claims, 5 Drawing Figures

BILL RECEIVING/DISPENSING APPARATUS

TECHNICAL FIELD

This invention relates to a bill discriminating apparatus applied to a vending machine or money changing machine, and more particularly a bill discriminating apparatus which can house and store bills inserted by users and return a desired number of bills.

BACKGROUND ART

In the conventional bill discriminating apparatus, a bill inserted through a slot is checked with respect to the configuration, photographic density, color, design, existence of magnetism, etc. during conveyance, and when it is identified as a true bill, a true bill signal is output, a vending machine or the like is operated and the bill is delivered to a bill storing device for storage therein.

Whenever a bill is inserted and housed in this way, the bill is subsequently placed on the stacked bills in the bill storing device which are stored in a neat stack.

When the bill inserted by a user for the purpose of a purchase is to be returned, one bill is extracted from among the stored bills and is sent out to the slot.

If a return lever is pushed down after five bills are inserted, it is necessary to safely return five bills one by one. The conventional apparatus, however, has a problem in reliability of securely returning one bill at a time and, depending upon the state of bills or the like, sometimes no bills, or sometimes two or three bills overlaid on each other are returned.

DISCLOSURE OF THE INVENTION

Accordingly, it is an object of the invention to provide an apparatus for discriminating bills which has reversing rollers provided in the passage which rotate reversely in relation to the bill conveying direction for the purpose of stopping any plurality of bills lifted up from a bill storing device, whereby only one bill at a time selected from among the plurality of bills stacked in the bill storing device is safely sent back to a slot.

BEST MODE FOR CARRYING OUT THE INVENTION

Figure 1:
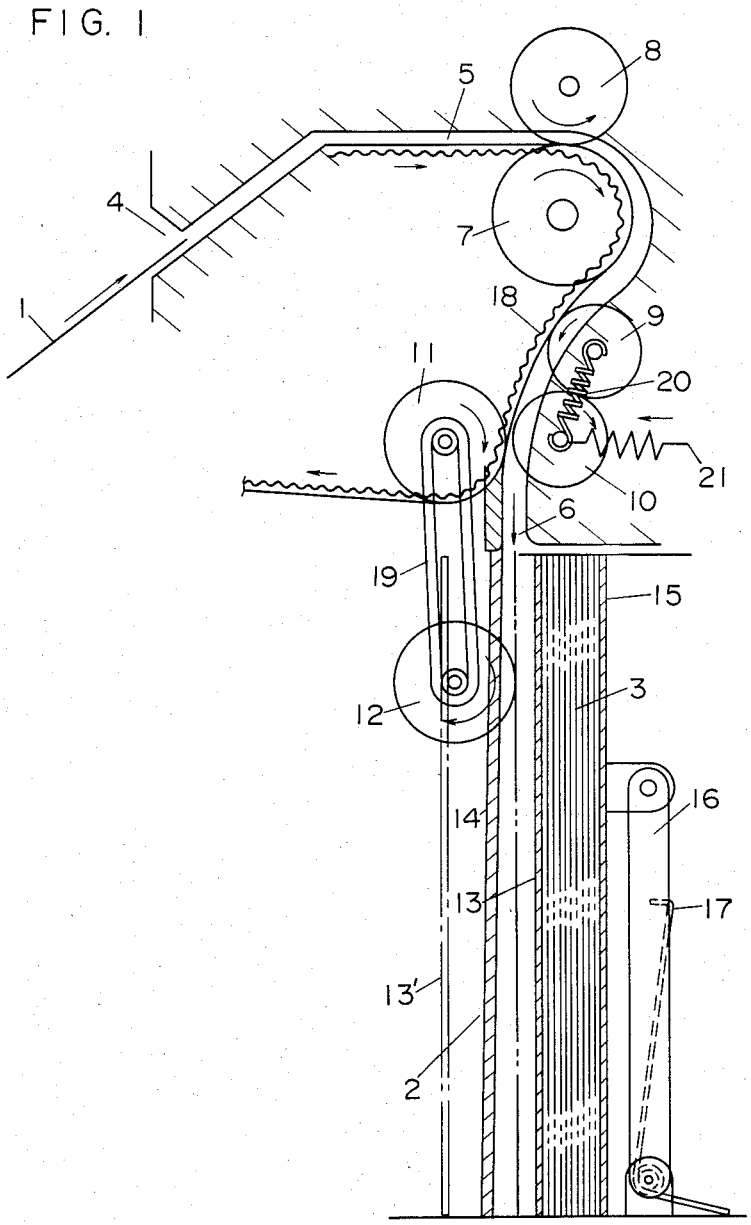
FIG. 1 is a sectional view of the main structure of an embodiment of a bill discriminating apparatus according to the invention.

FIG. 1 is a sectional view of a bill discriminating apparatus in the state of a bill being inserted. A bill 1 is to be inserted through a slot and housed in a bill storing device 2. Bills 3 previously inserted by other users are stacked in a neat stack.

The bill 1 inserted through a slot 4 is judged for authenticity by a judging device while being conveyed in the passage 5 of an apparatus body by a conveying device, and if it is recognized as a false bill, it is immediately sent back to the slot 4, while if it is recognized as a real bill, it is housed in the bill storing device 2.

The bill storing operation will be described hereinbelow. After the bill 1 passes a sensor provided immediately before an entrance 6, a signal is delivered to a motor of the conveying device, whereby the conveying motor and driving rollers 7, and hence, conveyor belts 18 and other rollers 8 to 12 are stopped.

As a result, the bill 1 having been in the bill storing device 2 is stopped in its current state.

A sliding plate 13 next starts linear reciprocating motions by rotation of a motor of the bill storing device 2. The sliding plate 13 is moved to the position 13' and is restored to its original position 13, whereby the bill 1 positioned between a guide plate 14 and the sliding plate 13 is moved to a position between the sliding plate 13 and a compression plate 15, the bill housing operation thus being completed. The reference numeral 16 denotes a lever, one end of which is attached to the back surface of the compression plate 15, and which is urged by a spring 17 in the direction in which the compression plate 15 presses the bills 3.

The conveyor belts 18 of the conveying device are disposed along the passage 5 in a manner as to intermesh with rollers 7 and 11, whereby rotation of the roller 7 drives the conveyor belts 18, the drive of which rotates the rollers 11. Extracting rollers 12 are connected to the rollers 11 by belts 19, whereby the extracting rollers 12 rotate in the same direction as the rollers 11 together with the rotation of the rollers 11.

Figure 2:
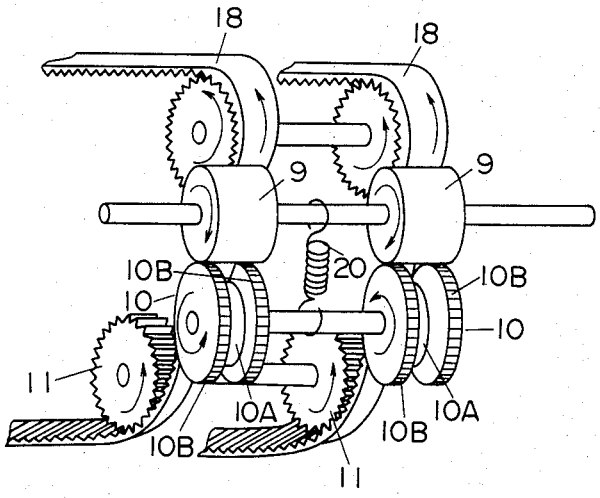
FIG. 2 is a perspective view of the driving mechanism of the apparatus.
Figure 3:
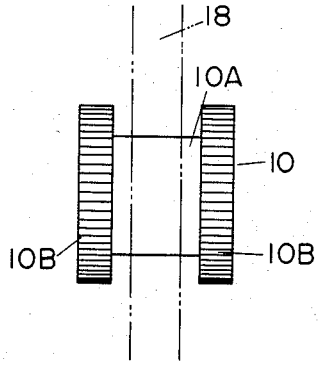
FIG. 3 is a side elevational view of a reverse roller employed in the driving mechanism.

Referring to FIG. 2 showing the structure of the rollers, the outer peripheral surfaces of the rollers 8 and 9 are in contact with the belts 18, the outer peripheral surfaces of the rollers 9 being in contact with the outer peripheral surfaces of the reverse rollers 10, and the conveying transmission force of the conveying belts 18 being transmitted to the reverse rollers 10 through the rollers 9. The respective rotating directions are indicated by the arrows in FIG. 2. The rollers 9 and the reverse rollers 10 are urged by a spring 20 such as to be constantly in contact with each other and at the same time biased toward the conveyor belts 18 by a compression spring 21. As shown in FIG. 3, the reverse roller 10 is composed of a middle portion 10A which is in contact with the conveyor belt 18 and which is formed of a resin having a low friction coefficient, and rubber rollers 10B, 10B which are attached to both sides of the middle portion 10A.

Figure 4:
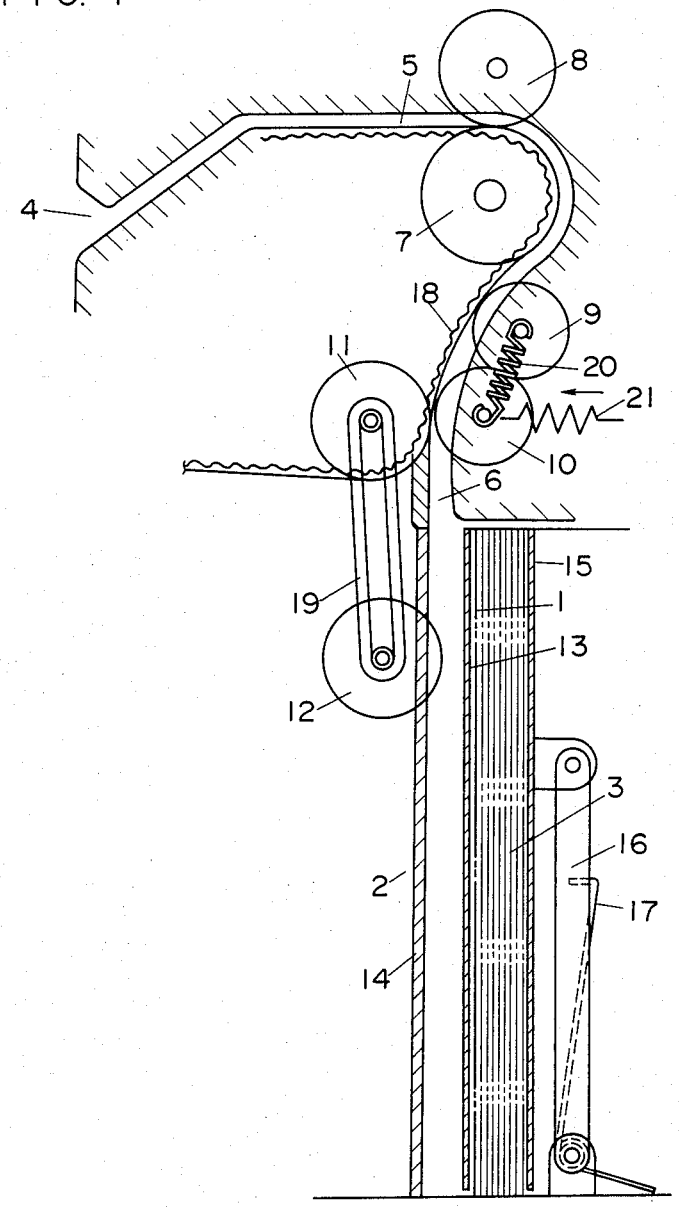
FIG. 4 is a sectional view of a bill storing device with stacked bills.

FIG. 4 is a sectional view of the apparatus with the bill 1 stored therein and shows the state in which a user is purchasing an article or waiting for the bill 1 to be returned. If an article has been purchased, the apparatus is ready to receive a bill from the next user, while if the return lever is pushed down, the relevant number of bills received from the user are returned, and, further, if a large denomination note is used and change in bills is necessary, the appropriate number of bills is returned.

Figure 5:
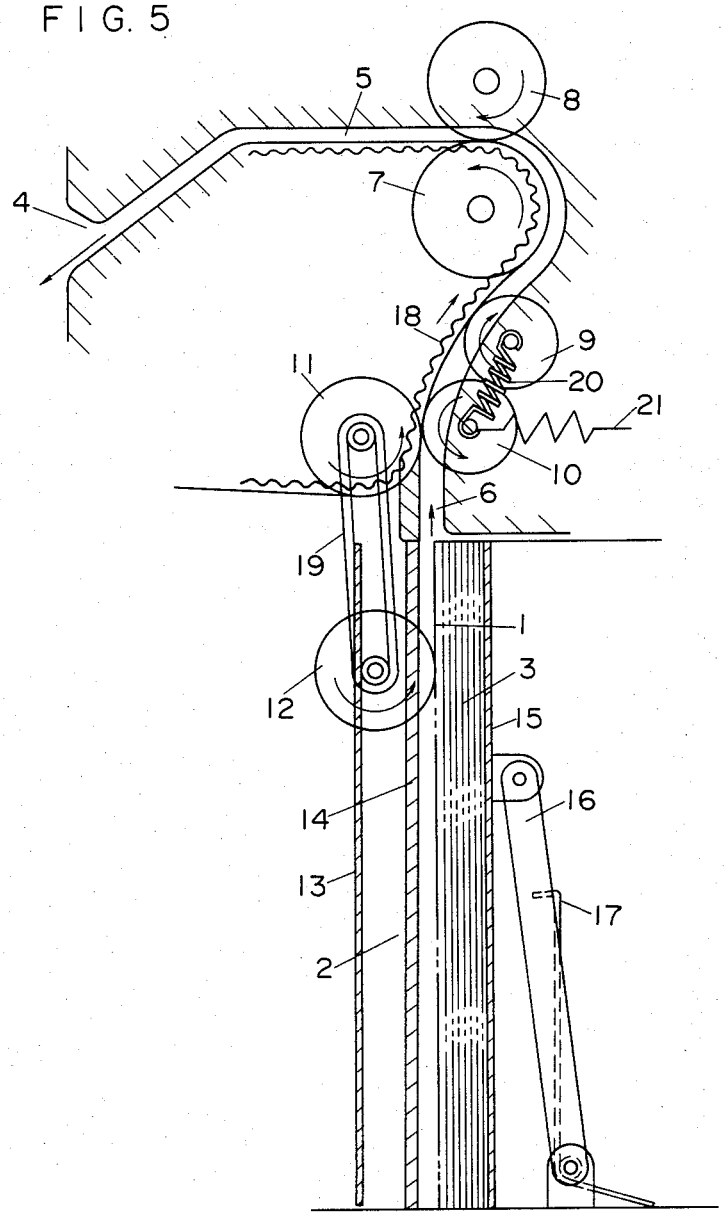
FIG. 5 is a sectional view of the bill storing device in the state of a bill being returned.

FIG. 5 is a sectional view of the apparatus in the state of a bill being returned.

In the Figures, the reference numeral 1 denotes the bill to be returned and 3 the remaining bills stored. In returning the bill 1, the extracting rollers 12 of the bill storing device 2 are first rotated in the arrowed direction, whereby the bill 1, which is pressed from the rear by the compression plate 15, comes into contact with the extracting rollers 12, is drawn up in the arrowed direction (in the direction of the entrance 6) and is lifted up to the passage 5 of the apparatus body. The lifted bill 1 is clamped by the conveyor belts 18 along the passage 5 and the rollers 8 and is conveyed to the slot, whereby the returning operation is finished.

In the conventional apparatus, however, rotation of the extracting rollers 12 in the arrow direction sometimes draws the bill at the top of the stack of the bills 3 together with the bill 1 in the arrow direction and the two bills are inconveniently returned at the same time. To eliminate this drawback, the apparatus according to the invention is provided in the entrance of the bill storing device 2 with the reversing rollers 10 which rotate reversely in relation to the relevant bill conveying direction, so that all the bills except the bill 1 are stopped in order to ensure that only one bill is returned.

When the bill 1 is conveyed to the passage 5 of the apparatus body from the bill storing device 2, the conveying belts 18 are rotating in the bill conveying direction, and the rollers 9, which are in contact with the conveying belts 18, are subjected to the rotation transmission of the conveyor belts 18 and rotate in the direction indicated by the arrow in FIG. 5, thereby conveying the bill 1 to the slot. At this time, the rotating force acting in the opposite direction relative to the rotation of the rollers 9, i.e. opposite to the bill conveying direction, is applied to the reversing rollers 10, which are in contact with the rollers 9 through the spring 20, and rotates the reversing rollers 10. This reverse rotation of the reversing rollers 10 stops all the bills drawn up from the bill storing device 2 except the bill 1, whereby only the first bill to be returned is safely returned.

As is shown in FIG. 1, since the rollers 9 and the reversing rollers 10 exist on the conveying belts 18, if the frictional force between the conveyor belts 18 and the reversing rollers 10 is too large, negative pressure is applied in the direction which leads to the stopping of the drive motor of the conveyor belts 18 and the worst state in which the motor is stopped is considered to be probable under bad conditions such as low voltage.

Accordingly, in the emboidment of the invention, the reversing roller 10 which rotates reversely with respect to the relevant bill conveying direction has a sandwich structure, in other words it is composed of a middle portion 10A formed of a resin and rubber rollers 10B attached to both sides of the middle portion 10A, such that the resin middle portion 10A is in contact with the conveyor belt 18 so as to reduce the frictional force produced when they rotate reversely to each other. By virtue of this structure, when the conveying transmission force from the conveying belts 18 is transmitted to the rubber rollers 10B of the reverse rollers 10 through the rollers 9 and reversely rotates the reversing rollers 10, contact of the conveyor belts 18 with the middle portions 10A produces only a small braking force. As a result, the load on the drive motor is reduced and the permissible range of the pressing force on the conveyor belts 18 is considerably enlarged.

INDUSTRIAL APPLICABILITY

As described above, an apparatus for discriminating bills according to the invention is provided with reversing rollers which rotate reversely in relation to the relevant bill conveying direction at a position opposite to a conveying device in the vicinity of a bill storing device. Operation of these reversing rollers enables the apparatus to safely pay out only one bill at a time by means of the conveying device when that bill has been extracted for returning from the bill storing device and even when a plurality of bills happen to be erroneously extracted.

What is claimed is:

1. A bill receiving/dispensing apparatus comprising:

a passage with a conveying device for conveying a bill inserted through a slot;

a bill storing device communicating with said passage for storing bills conveyed in a first direction by said conveying device in a neatly arranged stack; said conveying device being configured to rotate forwardly to convey bills to said storing device and reversely to convey stored bills to said slot when bills are paid out from said bill storing device; and a reversing roller for rotating reversely relative to a bill conveying direction of said conveying device, said reversing roller being provided in said passage and disposed at a position facing said conveying device in the vicinity of said bill storing device, said reversing roller causing only a single bill at a time to be completely extracted from said bill storing device and conveyed to said slot by said conveying device.

2. A bill receiving/dispensing apparatus according to claim 1, wherein said conveying device comprises a conveyor belt driven by a motor; and another roller rotating in said bill conveying direction with the outer peripheral surface thereof in contact with said conveyor belt such that said reversing roller rotates with the outer peripheral surface thereof in contact with said outer peripheral surface of said another roller.

3. A bill receiving/dispensing apparatus according to claim 2, wherein said reversing roller is composed of a middle portion formed of a resin and rubber rollers attached to both sides of said middle portion, said middle portion being in contact with said conveyor belt.

4. A bill receiving/dispensing apparatus according to claim 1, further comprising an extracting roller for extracting a bill from among said bills stored in said bill storing device and delivering said bill to said conveying device.

5. A bill receiving/dispensing apparatus comprising:

a passage with a conveying device for conveying a bill inserted through a slot;

a bill storing device for storing bills in a neatly arranged stack; said conveying device comprising a conveyor belt driven by a motor and a first roller rotating in the direction of said conveyor belt with the outer peripheral surface thereof being in contact with said conveyor belt, and said conveyor belt being configured to rotate forwardly to convey bills from said slot to said storing device and reversely when bills are paid out from the bill storing device to said slot; and a reversing roller provided at a position facing said conveyor belt in the vicinity of said bill storing device such that the outer peripheral surface of said reversing roller is in contact with said outer peripheral surface of said first roller to thereby rotate reversely to a bill conveying direction, said reversing roller causing only a single bill at a time to be completely extracted from said bill storing device and conveyed to said slot by said conveyor belt.

6. A bill receiving/dispensing apparatus according to claim 5, wherein said reversing roller is composed of a middle portion formed of a resin and rubber rollers attached to both sides of said middle portion, said middle portion being in contact with said conveyor belt.

* * * * *